US009897044B2

(12) United States Patent
Tanaka et al.

(10) Patent No.: US 9,897,044 B2
(45) Date of Patent: Feb. 20, 2018

(54) CONTROL SYSTEM OF ENGINE

(71) Applicant: Mazda Motor Corporation, Aki-gun, Hiroshima (JP)

(72) Inventors: Kazuaki Tanaka, Higashihiroshima (JP); Yuusou Sakamoto, Iwakuni (JP); Hiroshi Tsuboi, Yokohama (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 0 days.

(21) Appl. No.: 15/007,519

(22) Filed: Jan. 27, 2016

(65) Prior Publication Data

US 2016/0230707 A1 Aug. 11, 2016

(30) Foreign Application Priority Data

Feb. 10, 2015 (JP) ..... 2015-024099

(51) Int. Cl.
*F01N 3/00* (2006.01)
*F01N 3/10* (2006.01)
(Continued)

(52) U.S. Cl.
CPC ..... *F02M 25/0836* (2013.01); *F01N 3/20* (2013.01); *F02D 41/0035* (2013.01);
(Continued)

(58) Field of Classification Search
CPC ..... F01N 3/20; F01N 2610/1473; F02D 2200/0804; F02D 41/0032; F02D 41/0035;
(Continued)

(56) References Cited

U.S. PATENT DOCUMENTS 5,469,833 A * 11/1995 Hara ..... F02D 41/0032 123/698
2007/0227515 A1* 10/2007 Uchida ..... F02M 25/089 123/520
(Continued)

FOREIGN PATENT DOCUMENTS

JP H04358755 A 12/1992
JP 2004076673 A 3/2004
(Continued)

*Primary Examiner* — Phutthiwat Wongwian
*Assistant Examiner* — Diem Tran
(74) *Attorney, Agent, or Firm* — Alleman Hall Creasman & Tuttle LLP

(57) ABSTRACT

A control system of an engine is provided. The control system includes an exhaust emission control catalyst provided in an exhaust passage, a deceleration fuel cutoff module for performing a deceleration fuel cutoff when a deceleration fuel cutoff condition is satisfied in an engine decelerating state, a purging unit for performing a purge to supply a purge gas to an intake passage during the deceleration fuel cutoff, an evaporated fuel supply amount estimating module for estimating a supply amount of evaporated fuel to the intake passage when the purge is performed, and a catalyst temperature estimating module for estimating a temperature of the exhaust emission control catalyst when the purge is performed, based on the supply amount of the evaporated fuel. The purging unit controls a supply flow rate of the purge gas to the intake passage when the purge is performed, based on the exhaust emission control catalyst temperature.

16 Claims, 8 Drawing Sheets

(51) Int. Cl.

| | |
|---|---|
| ***F02M 25/08*** | (2006.01) |
| ***F02D 41/02*** | (2006.01) |
| ***F02D 41/12*** | (2006.01) |
| ***F01N 3/20*** | (2006.01) |
| ***F02D 41/00*** | (2006.01) |

(52) U.S. Cl.
CPC ..... *F02D 41/0045* (2013.01); *F02D 41/0235* (2013.01); *F02D 41/123* (2013.01); *F02D 2200/0804* (2013.01)

(58) Field of Classification Search
CPC ..... F02D 41/0045; F02D 41/0042; F02D 41/0235; F02D 41/123; F02D 2250/41
USPC ..... 60/276, 283, 285, 299
See application file for complete search history.

(56) References Cited

U.S. PATENT DOCUMENTS

2015/0121864 A1* 5/2015 Surnilla ..... F02D 41/0052 60/605.2
2015/0158378 A1* 6/2015 Dudar ..... B60K 15/03 701/22

FOREIGN PATENT DOCUMENTS

JP 2007198210 A 8/2007
JP 2009024612 A 2/2009

* cited by examiner

CONTROL SYSTEM OF ENGINE

BACKGROUND

The present invention relates to a technical field of a control system of an engine in which a purge gas containing evaporated fuel desorbed from a canister is supplied to an intake passage.

Conventionally, arts are known, in which during a deceleration fuel cutoff of the engine, when it is determined that evaporated fuel easily overflows from a canister, the purge gas containing the evaporated fuel desorbed from the canister is supplied to an intake passage of an engine. For example, JP2007-198210A discloses such an art. By supplying the purge gas to the intake passage during the deceleration fuel cutoff as above, the overflow of the evaporated fuel from the canister can be reduced. Although the evaporated fuel within the purge gas supplied to the intake passage is discharged unburned to an exhaust passage through the engine, the unburned evaporated fuel can be purified by an exhaust emission control catalyst provided in the exhaust passage.

Further, in JP2007-198210A, when a temperature of the exhaust emission control catalyst is detected and the detected result indicates a temperature below a predetermined value, the supply of the purge gas to the intake passage is reduced to suppress degradation of emission performance.

However, in JP2007-198210A, even when the purge gas is supplied to the intake passage when the temperature of the exhaust emission control catalyst is the predetermined value or higher, depending on the temperature of the exhaust emission control catalyst, if an excessive amount of unburned evaporated fuel reaches the exhaust emission control catalyst, the emission performance may still degrade, which leaves room for improvement.

SUMMARY

The present invention is made in view of the above situations and aims to secure as much as possible, when purge gas is supplied to an intake passage (when a purge is performed) during a deceleration fuel cutoff of an engine, a supply amount of the purge gas to the intake passage while suppressing degradation of emission performance.

According to one aspect of the present invention, a control system of an engine in which a purge gas containing evaporated fuel desorbed from a canister is supplied to an intake passage of the engine, is provided. The control system includes an exhaust emission control catalyst provided in an exhaust passage of the engine, a deceleration fuel cutoff module for performing a deceleration fuel cutoff to stop a fuel supply from an injector to the engine when a predetermined deceleration fuel cutoff condition is satisfied in a decelerating state of the engine, a purging unit for performing a purge to supply the purge gas to the intake passage of the engine during the deceleration fuel cutoff, an evaporated fuel supply amount estimating module for estimating a supply amount of the evaporated fuel to the intake passage when the purge is performed, and a catalyst temperature estimating module for estimating a temperature of the exhaust emission control catalyst when the purge is performed, based on the estimated supply amount of the evaporated fuel. The purging unit controls a supply flow rate of the purge gas to the intake passage when the purge is performed, based on the estimated temperature of the exhaust emission control catalyst.

With the above-described configuration, the supply flow rate of the purge gas to the intake passage when the purge is performed can be adjusted according to purifying performance of the exhaust emission control catalyst which is influenced by its temperature, and a supply amount of the purge gas to the intake passage can be secured as much as possible while suppressing degradation of emission performance.

The purging unit preferably reduces the supply flow rate of the purge gas to the intake passage when the purge is performed, as the estimated temperature of the exhaust emission control catalyst becomes lower.

As the temperature of the exhaust emission control catalyst becomes lower, the purifying performance of the exhaust emission control catalyst degrades more. Therefore, the supply flow rate of the purge gas to the intake passage when the purge is performed can suitably be set corresponding to the relationship between the temperature of the exhaust emission control catalyst and the purifying performance.

The purging unit preferably stops the purge when the estimated temperature of the exhaust emission control catalyst falls below a predetermined temperature while the purge is performed.

By setting the predetermined temperature so that the purifying performance of the exhaust emission control catalyst significantly degrades when falling below the predetermined temperature (e.g., equal or close to an activation temperature of the exhaust emission control catalyst), the degradation of the emission performance can surely be suppressed.

The control system preferably further includes a catalyst temperature increasing amount estimating module for continuously estimating an increasing amount of the temperature of the exhaust emission control catalyst when unburned evaporated fuel accumulated in the exhaust emission control catalyst by the purge performed is assumed to have entirely combusted at once. While the purge is performed, the purging unit preferably stops the purge once the increasing amount of the estimated temperature of the exhaust emission control catalyst exceeds a preset value.

When the deceleration fuel cutoff is ended and shifted to a normal operation of the engine (operation in which the injector supplies fuel to the engine and the fuel is combusted), the unburned evaporated fuel accumulated in the exhaust emission control catalyst by the purge during the deceleration fuel cutoff is entirely combusted at once due to exhaust gas at high temperature which is produced by combustion of the fuel injected by the injector. Thus, the temperature of the exhaust emission control catalyst sharply increases. Here, if the temperature increases excessively, deterioration of the exhaust emission control catalyst will be stimulated. With this configuration, the increasing amount of the temperature of the exhaust emission control catalyst when the unburned evaporated fuel accumulated in the exhaust emission control catalyst due to the purge during the deceleration fuel cutoff is assumed to have entirely combusted at once, is continuously estimated. The purge is stopped when the increasing amount of the temperature exceeds the preset value, and after stopped, the unburned evaporated fuel is not accumulated in the exhaust emission control catalyst. Thus, the increasing amount of the temperature of the exhaust emission control catalyst when the deceleration fuel cutoff is ended and shifted to the normal operation of the engine can be a value (the preset value) set so that the deterioration of the exhaust emission control catalyst due to the sharp temperature increase can be suppressed.

The control system preferably further includes an evaporated fuel concentration estimating module for estimating a concentration of the evaporated fuel within the purge gas when the purge is performed. The purging unit preferably further controls the supply flow rate of the purge gas to the intake passage when the purge is performed, based on the estimated concentration of the evaporated fuel.

When the concentration of the evaporated fuel within the purge gas is high, the unburned evaporated fuel may not be purified by the exhaust emission control catalyst and the emission performance may degrade. By controlling the supply flow rate of the purge gas to the intake passage when the purge is performed based on the temperature of the exhaust emission control catalyst as well as the concentration of the evaporated fuel, the degradation of the emission performance can more surely be suppressed.

The purging unit preferably does not perform the purge during the deceleration fuel cutoff when the estimated concentration of the evaporated fuel is above a predetermined concentration.

By not performing the purge during the deceleration fuel cutoff when the concentration of the evaporated fuel is high enough that the evaporated fuel cannot suitably be purified by the exhaust emission control catalyst, suitable emission performance can be secured.

The control system preferably further includes an exhaust gas temperature detecting/estimating module for detecting or estimating a temperature of exhaust gas of the engine when the engine is operated by supplying fuel from the injector to the engine and combusting the fuel. The catalyst temperature estimating module preferably estimates the temperature of the exhaust emission control catalyst when the purge is performed, based on the temperature of the exhaust gas detected or estimated immediately before the deceleration fuel cutoff is started, the estimated supply amount of the evaporated fuel, a heat generation amount, and a heat release amount, the heat generation amount produced by combustion, at the exhaust emission control catalyst, of part of the evaporated fuel which has reached the exhaust emission control catalyst when the purge is performed, the heat release amount produced from the exhaust emission control catalyst to air passing through the exhaust emission control catalyst when the purge is performed.

With this configuration, the estimation of the temperature of the exhaust emission control catalyst can suitably be achieved.

The control system preferably further includes a turbocharger having a compressor disposed in the intake passage of the engine. The purging unit preferably includes a purge line communicating the canister with part of the intake passage downstream of the compressor, a purge valve provided in the purge line, and a purge valve controlling module for controlling the supply flow rate of the purge gas to the intake passage by controlling an operation of the purge valve when the purge is performed.

In the case where the turbocharger is provided to the engine as described above, during the normal operation of the engine, the pressure in the intake passage at the connection position with the purge line rarely becomes negative, and thus the purge is rarely performed. However, according to this aspect of the present invention, the supply flow rate of the purge gas to the intake passage when the purge is performed is controlled based on the estimated temperature of the exhaust emission control catalyst, while the purge is performed during the deceleration fuel cutoff. Therefore, the supply amount of the purge gas to the intake passage can be secured as much as possible while suppressing the degradation of the emission performance. As a result, the operations of the present invention can effectively be achieved and the effects can effectively be exerted.

DETAILED DESCRIPTION OF EMBODIMENT

Hereinafter, one embodiment of the present invention is described in detail with reference to the appended drawings.

Figure 1:
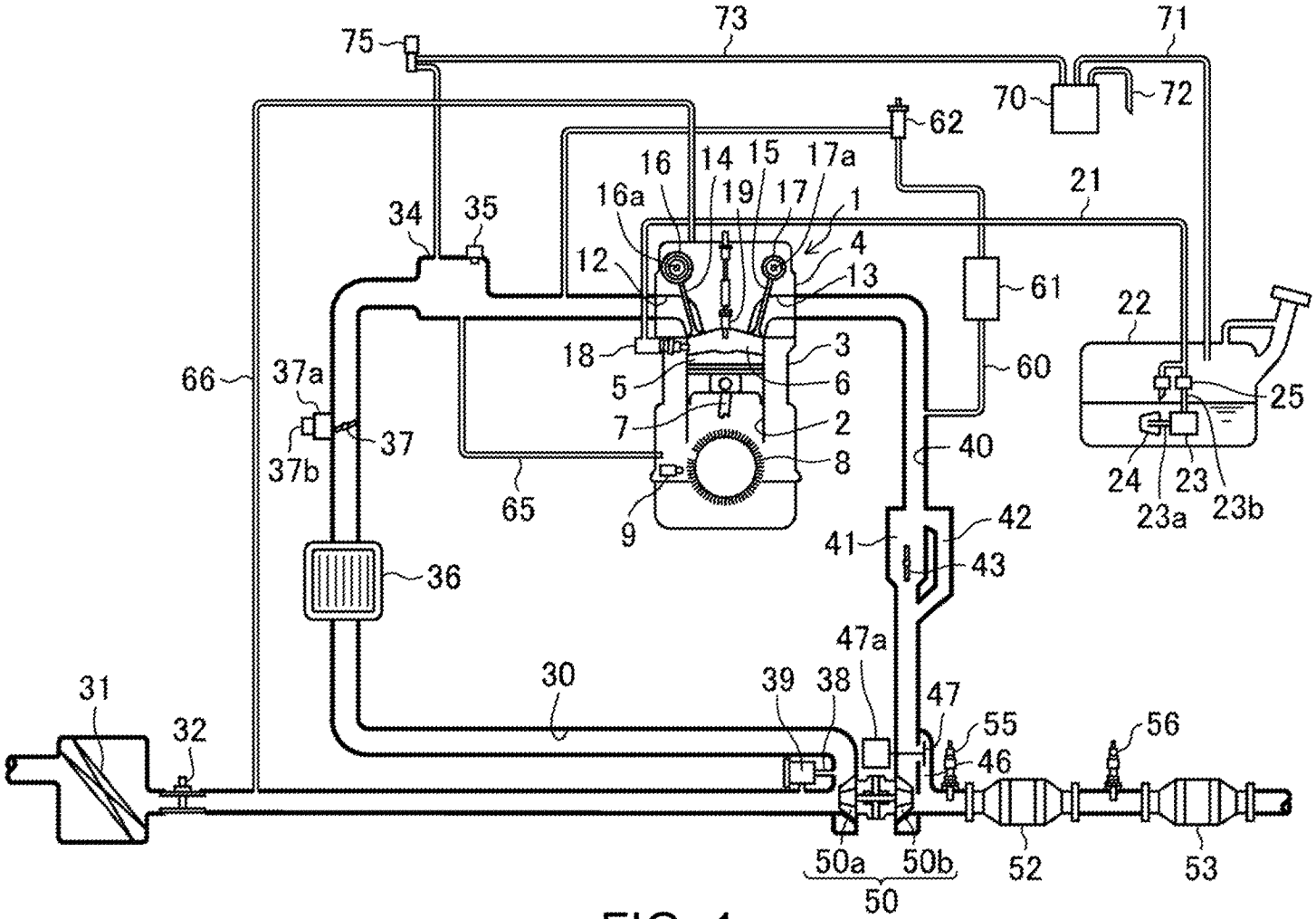
FIG. 1 is a view illustrating a schematic configuration of an engine controlled by a control system according to one embodiment of the present invention.

FIG. 1 is a view illustrating a schematic configuration of an engine 1 controlled by a control system 100 (see FIG. 2) according to one embodiment of the present invention. The engine 1 is a gasoline engine mounted on a vehicle and having a turbocharger. The engine 1 includes a cylinder block 3 where a plurality of cylinders 2 (only one cylinder is illustrated in FIG. 1) are arranged in a line, and a cylinder head 4 disposed on the cylinder block 3. A piston 5 defining a combustion chamber 6 together with the cylinder head 4 therebetween is reciprocatably fitted into each of the cylinders 2 of the engine 1. The piston 5 is coupled to a crankshaft (not illustrated) through a connecting rod 7. To the crankshaft, a detecting plate 8 for detecting a rotational angular position of the crankshaft is fixed to integrally rotate therewith, and an engine speed sensor 9 for detecting the rotational angular position of the detecting plate 8 to detect a speed of the engine 1.

In the cylinder head 4, an intake port 12 and an exhaust port 13 are formed for each cylinder 2, and an intake valve 14 for opening and closing the intake port 12 on the combustion chamber 6 side and an exhaust valve 15 for opening and closing the exhaust port 13 on the combustion chamber 6 side are provided for each cylinder 2. Each intake valve 14 is driven by an intake valve drive mechanism 16, and each exhaust valve 15 is driven by an exhaust valve drive mechanism 17. The intake and exhaust valves 14 and 15 reciprocate at predetermined timings by the intake and exhaust valve drive mechanisms 16 and 17, respectively, to open and close the intake and exhaust ports 12 and 13, and thus, gas inside the cylinder 2 is exchanged. The intake and exhaust valve drive mechanisms 16 and 17 have an intake camshaft 16*a* and an exhaust camshaft 17*a* which are coupled to the crankshaft to be drivable, respectively. The camshafts 16*a* and 17*a* rotate in synchronization with the rotation of the crankshaft. Moreover, the intake valve drive mechanism 16 includes a hydraulically/mechanically-driven phase variable mechanism (Variable Valve Timing: VVT) for varying a phase of the intake camshaft 16*a* within a predetermined angle range.

An injector 18 for injecting fuel (in this embodiment, gasoline) is provided in an upper (cylinder head 4 side) end part of the cylinder block 3 for each cylinder 2. The injector 18 is disposed such that a fuel injection port thereof is oriented toward an inside of the combustion chamber 6, and directly injects the fuel into the combustion chamber 6 near a top dead center of compression stroke (CTDC). Note that the injectors 18 may be provided to the cylinder head 4.

The injectors 18 are connected to a fuel tank 22 via a fuel supply tube 21. Inside the fuel tank 22, a fuel pump 23 is disposed to be submerged in the fuel. The fuel pump 23 has a suction tube 23*a* for sucking the fuel, and a discharge tube 23*b* for discharging the sucked fuel. The suction tube 23*a* has a strainer 24 at its tip. The discharge tube 23*b* is connected to the injector 18 via a regulator 25. The fuel pump 23 sucks the fuel with the suction tube 23*a* and then discharges the fuel with the discharge tube 23*b*, so as to send the fuel to the injector 18 after a pressure adjustment at the regulator 25. Specifically, the fuel supply tube 21 is connected to a fuel distribution tube (not illustrated) extending in a cylinder row direction; the fuel distribution tube is connected to the injectors 18 of the respective cylinders 2, and thus, the fuel from the fuel pump 23 is distributed to the injectors 18 of the respective cylinders 2 by the fuel distribution tube.

Inside the cylinder head 4, an ignition plug 19 is disposed for each cylinder 2. A tip part (electrode) of the ignition plug 19 is located near a ceiling of the combustion chamber 6. Further, the ignition plug 19 produces a spark at a predetermined ignition timing, and thus mixture gas of the fuel and air is combusted in response to the spark.

On one side surface of the engine 1, an intake passage 30 is connected to communicate with the intake ports 12 of the cylinders 2. An air cleaner 31 for filtrating intake air is disposed in an upstream end part of the intake passage 30, and the intake air filtered by the air cleaner 31 is supplied to each combustion chamber 6 of the cylinder 2 via the intake passage 30 and the intake port 12.

An airflow sensor 32 for detecting a flow rate of the intake air sucked into the intake passage 30 is disposed at a position of the intake passage 30 near the downstream side of the air cleaner 31. Further, a surge tank 34 is disposed near a downstream end of the intake passage 30. Part of the intake passage 30 downstream of the surge tank 34 is branched into independent passages extending toward the respective cylinders 2, and downstream ends of the independent passages are connected to the intake ports 12 of the cylinders 2, respectively. A pressure sensor 35 for detecting pressure inside the surge tank 34 is disposed in the surge tank 34.

Moreover, in the intake passage 30, a compressor 50*a* of a turbocharger 50 is disposed between the airflow sensor 32 and the surge tank 34. The intake air is turbocharged by the compressor 50*a* in operation.

Furthermore, in the intake passage 30, an intercooler 36 for cooling air compressed by the compressor 50*a*, and a throttle valve 37 are arranged between the compressor 50*a* of the turbocharger 50 and the surge tank 34 in this order from the upstream side. The throttle valve 37 is driven by a drive motor 37*a* to change a cross-sectional area of the intake passage 30 at the disposed position of the throttle valve 37, so as to adjust an amount of intake air to flow into the combustion chambers 6 of the respective cylinders 2. An opening of the throttle valve 37 is detected by a throttle opening sensor 37*b*.

Additionally in this embodiment, an intake bypass passage 38 for bypassing the compressor 50*a* is provided to the intake passage 30, and an air bypass valve 39 is provided in the intake bypass passage 38. The air bypass valve 39 is normally fully closed, but for example when the opening of the throttle valve 37 is sharply reduced, a sharp increase and surging of pressure occur in the part of the intake passage 30 upstream of the throttle valve 37 and the rotation of the compressor 50*a* is disturbed, which results in causing a loud noise; therefore the air bypass valve 39 is opened to prevent such a situation.

On the other side surface of the engine 1, an exhaust passage 40 is connected to discharge exhaust gas from the combustion chambers 6 of the cylinders 2. An upstream part of the exhaust passage 40 is comprised of an exhaust manifold having independent passages extending to the respective cylinders 2 and connected to respective external ends of the exhaust ports 13 of the cylinders 2, and a manifold section where the respective independent passages are collected together. A turbine 50*b* of the turbocharger 50 is disposed in part of the exhaust passage 40 downstream of the exhaust manifold. The turbine 50*b* is rotated by the flow of the exhaust gas, and the compressor 50*a* coupled to the turbine 50*b* is operated by the rotation of the turbine 50*b*.

Part of the exhaust passage 40 which is downstream of the exhaust manifold and upstream of the turbine 50*b* is branched into a first passage 41 and a second passage 42. A flow rate changing valve 43 for changing a flow rate of the exhaust gas flowing toward the turbine 50*b* is provided in the first passage 41. The second passage 42 merges with the first passage 41 at a position downstream of the flow rate changing valve 43 and upstream of the turbine 50*b*.

Further, an exhaust bypass passage 46 for guiding the exhaust gas of the engine 1 to flow while bypassing the turbine 50*b* is provided in the exhaust passage 40. An end part of the exhaust bypass passage 46 on the flow-in side of the exhaust gas (an upstream end part of the exhaust bypass passage 46) is connected to a position of the exhaust passage 40 between the merging section of the first and second passages 41 and 42 in the exhaust passage 40 and the turbine 50*b*. An end part of the exhaust bypass passage 46 on the flow-out side of the exhaust gas (a downstream end part of the exhaust bypass passage 46) is connected to a position of the exhaust passage 40 downstream of the turbine 50*b* and upstream of an upstream exhaust emission control catalyst 52 (described later).

The end part of the exhaust bypass passage 46 on the flow-in side of the exhaust gas is provided with a wastegate valve 47 that is driven by a drive motor 47*a*. The wastegate valve 47 is controlled by the control system 100 according to an operating state of the engine 1. When the wastegate valve 47 is fully closed, the entire amount of exhaust gas flows to the turbine 50*b*, and when the wastegate valve 47 is not fully closed, the flow rate of the exhaust gas to the exhaust bypass passage 46 (i.e., the flow rate of the exhaust gas to the turbine 50*b*) changes according to the opening of the wastegate valve 47. In other words, as the opening of the wastegate valve 47 becomes larger, the flow rate of the exhaust gas to the exhaust bypass passage 46 becomes higher, and the flow rate of the exhaust gas to the turbine 50*b* becomes lower. When the wastegate valve 47 is fully opened, the turbocharger 50 substantially does not operate.

Part of the exhaust passage 40 downstream of the turbine 50*b* (downstream of the position connected to the downstream end part of the exhaust bypass passage 46) is provided with exhaust emission control catalysts 52 and 53 constructed with an oxidation catalyst, etc., and for purifying hazardous components contained within the exhaust gas (and unburned evaporated fuel during a deceleration fuel cutoff, described later). In this embodiment, the two exhaust emission control catalysts, the upstream exhaust emission control catalyst 52 and the downstream exhaust emission control catalyst 53, are provided. However, just the upstream exhaust emission control catalyst 52 may be provided, instead.

In the exhaust passage 40, a linear $O_2$ sensor 55 having an output property which is linear with respect to an oxygen concentration within the exhaust gas is disposed near the upstream side of the upstream exhaust emission control catalyst 52. The linear O2 sensor 55 is an air-fuel ratio sensor for detecting the oxygen concentration within the exhaust gas for the purpose of performing a feedback control of an air-fuel ratio within the combustion chambers 6. Further in the exhaust passage 40, an $O_2$ sensor 56 for detecting whether the air-fuel ratio of the exhaust gas which has passed through the upstream exhaust emission control catalyst 52 is stoichiometric, rich, or lean is disposed between the upstream and downstream exhaust emission control catalysts 52 and 53.

The engine 1 includes an EGR passage 60 for recirculating part of the exhaust gas from the exhaust passage 40 to the intake passage 30. The EGR passage 60 connects the part of the exhaust passage 40 upstream of the branched section of the first and second passages 41 and 42 to the independent passages of the intake passage 30 downstream of the surge tank 34. An EGR cooler 61 for cooling the exhaust gas passing therethrough and an EGR valve 62 for adjusting an amount of the exhaust gas recirculated by the EGR passage 60 are disposed in the EGR passage 60.

The engine 1 also includes first and second ventilation hoses 65 and 66 for returning back to the intake passage 30 blow-by gas leaked from the combustion chambers 6. The first ventilation hose 65 connects a lower part (crank case) of the cylinder block 3 to the surge tank 34, and the second ventilation hose 66 connects an upper part of the cylinder head 4 to part of the intake passage 30 between the air cleaner 31 and the compressor 50*a*.

The fuel tank 22 is connected to a canister 70 containing an adsorbent (e.g., activated charcoal) therein, via a connecting tube 71. Fuel evaporated inside the fuel tank 22 flows to the canister 70 via the connecting tube 71 and is trapped by the canister 70 (adsorbent). An inside of the canister 70 communicates with ambient air via an ambient air communicating tube 72.

The canister 70 is connected to the intake passage 30 via a purge tube 73 (purge line). In this embodiment, an end part of the purge tube 73 on the intake passage 30 side is connected to the surge tank 34 provided downstream of the compressor 50*a* in the intake passage 30.

The purge tube 73 is provided with a purge valve 75. When the purge valve 75 is opened and the pressure inside the surge tank 34 is negative (i.e., when the intake air is not turbocharged by the compressor 50*a* of the turbocharger 50), the ambient air (air) is introduced into the ambient air communicating tube 72, the evaporated fuel trapped in the canister 70 is desorbed therefrom by the flow of the air, and then the desorbed evaporated fuel is supplied along with the air as purge gas, to the surge tank 34 (a purge is performed). A supply flow rate (or a supply amount) of the purge gas to the surge tank 34 (intake passage 30) is determined based on an opening of the purge valve 75 and a pressure difference Pd between the pressure inside the surge tank 34 (the pressure detected by the pressure sensor 35) and atmospheric pressure (pressure detected by an atmospheric pressure sensor 91 described later).

Figure 2:
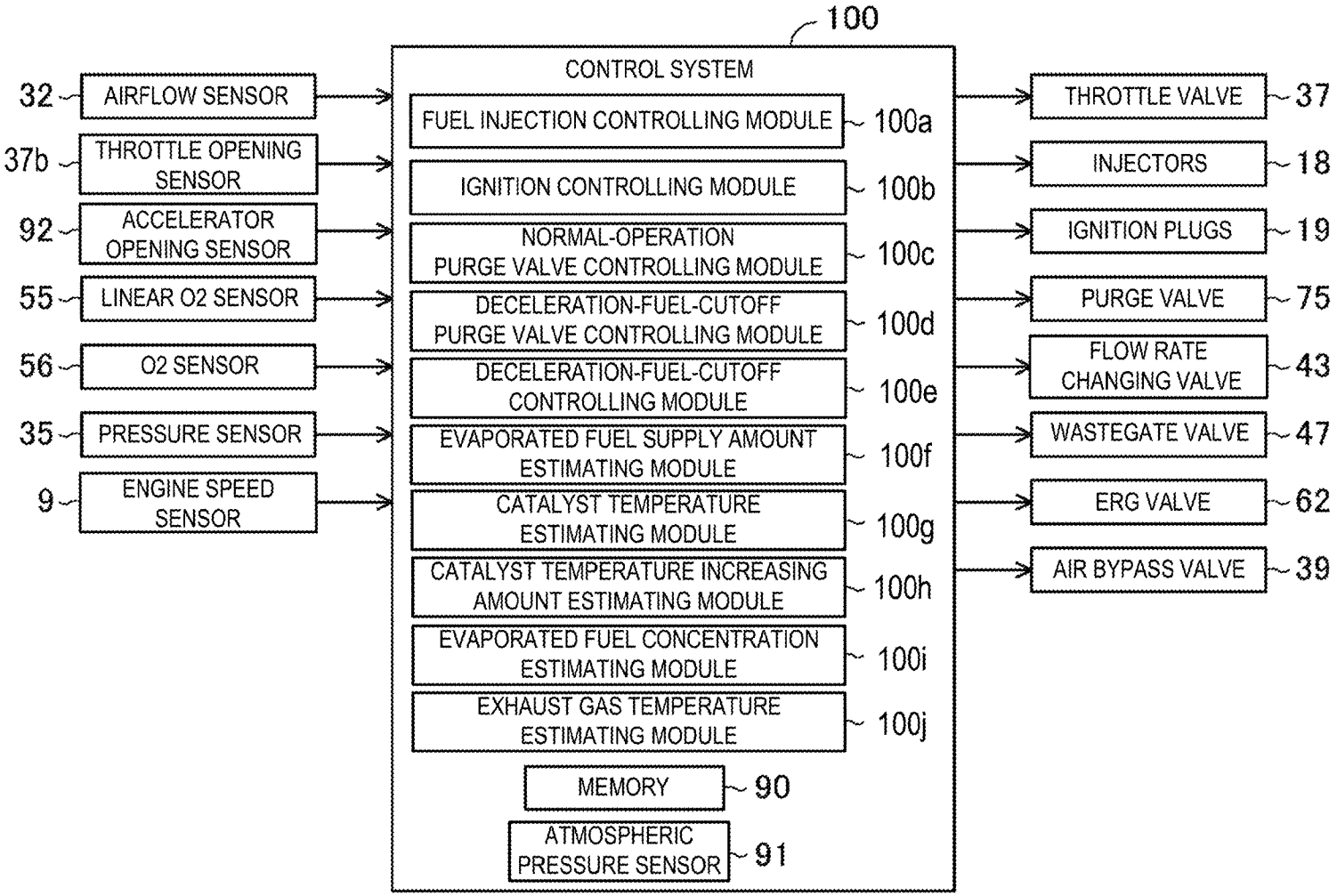
FIG. 2 is a block diagram illustrating a configuration of the control system of the engine.

As illustrated in FIG. 2, operations of the throttle valve 37 (specifically, the drive motor 37*a*), the injectors 18, the ignition plugs 19, the purge valve 75, the flow rate changing valve 43, the wastegate valve 47 (specifically, the drive motor 47*a*), the EGR valve 62, and the air bypass valve 39 are controlled by the control system 100. The control system 100 is a controller based on a well-known microcomputer, and includes a central processing unit (CPU) for executing program(s), a memory 90 comprised of, for example, a RAM and/or a ROM and for storing the program(s) and data, and an input/output (I/O) bus for inputting and outputting electric signals (FIG. 2 only illustrates the memory 90 thereamong).

The control system 100 receives signals indicating output values of various sensors including the airflow sensor 32, the throttle opening sensor 37*b*, an accelerator opening sensor 92 for detecting a stepping amount of an acceleration pedal (accelerator opening) by a driver of the vehicle on which the engine 1 is mounted, the linear $O_2$ sensor 55, the $O_2$ sensor 56, the pressure sensor 35, and the engine speed sensor 9. In this embodiment, the control system 100 is built therein with the atmospheric pressure sensor 91 for detecting the atmospheric pressure. The control system 100 controls the operations of the valves described above, based on the output values of the various sensors. Specifically, the operation control of the injectors 18 (fuel injection control) is performed by a fuel injection controlling module 100*a* of the control system 100, the operation control of the ignition plugs 19 is performed by an ignition controlling module 100*b* of the control system 100, and the operation control of the purge valve 75 (opening control, i.e., the control of the supply flow rate of the purge gas to the surge tank 34) is performed by one of a normal-operation purge valve controlling module 100*c* and a deceleration-fuel-cutoff purge valve controlling module 100*d* of the control system 100. Note that the operation control of the purge valve 75 by one of the normal-operation purge valve controlling module 100*c* and the deceleration-fuel-cutoff purge valve controlling module 100*d* of the control system 100 is performed through a control of a duty ratio of a control signal transmitted to the purge valve 75 (a duty control of the purge valve 75).

The control system 100 also includes a deceleration-fuel-cutoff controlling module 100*e* (deceleration fuel cutoff module), an evaporated fuel supply amount estimating module 100*f*, a catalyst temperature estimating module 100*g*, a catalyst temperature increasing amount estimating module 100*h*, an evaporated fuel concentration estimating module 100*i*, and an exhaust gas temperature estimating module 100*j*, which are described later in detail.

When a predetermined deceleration fuel cutoff condition is satisfied when the engine 1 is in a decelerating state, the deceleration-fuel-cutoff controlling module 100*e* performs a deceleration fuel cutoff to stop the fuel supply from the injectors 18 to the engine 1. The predetermined deceleration fuel cutoff condition is, for example, a condition in which the opening of the throttle valve 37 is detected by the throttle opening sensor 37*b* as fully closed and the speed of the engine 1 is detected by engine speed sensor 9 as above a predetermined speed (slightly above an idling speed). During the deceleration fuel cutoff, the injectors 18 and the ignition plugs 19 are not operated.

During the deceleration fuel cutoff, the deceleration-fuel-cutoff purge valve controlling module 100*d* controls the operation of the purge valve 75 (the supply flow rate of the purge gas to the surge tank 34). Specifically, the purge to supply the purge gas to the surge tank 34 is performed during a normal operation of the engine 1 (operation in which the fuel is injected by the injectors 18 and the injected fuel is ignited by the ignition plugs 19) and also during the deceleration fuel cutoff. The operation control of the purge valve 75 during the deceleration fuel cutoff is described later. In this embodiment, the purge tube 73 (purge line), the purge valve 75, and the deceleration-fuel-cutoff purge valve controlling module 100*d* (purge valve controlling module) constitute a purging unit for performing the purge to supply the purge gas to the intake passage 30 of the engine 1 during the deceleration fuel cutoff.

On the other hand, during the normal operation of the engine 1 (other than the deceleration fuel cutoff), the normal-operation purge valve controlling module 100*c* controls the operation of the purge valve 75 according to the operating state of the engine 1. In this embodiment, when the engine 1 is in an operating state where the turbocharger 50 is operated to turbocharge the intake air, since the pressure inside the surge tank 34 is not negative, the normal-operation purge valve controlling module 100*c* fully closes the purge valve 75, and when the engine 1 is in an operating state where the turbocharger 50 is not operated, the normal-operation purge valve controlling module 100*c* performs the purge.

When the purge is performed during the normal operation of the engine 1, the evaporated fuel concentration estimating module 100*i* learns by estimation a concentration of the evaporated fuel within the purge gas based on a feedback correction amount of the air-fuel ratio obtained based on the output value of the linear $O_2$ sensor 55, and the evaporated fuel concentration estimating module 100*i* stores (updates) the learned value of the concentration of the evaporated fuel in the memory 90. The fuel injection controlling module 100*a* corrects the fuel injection amount based on the feedback correction amount and the learned value.

In other words, a shift of the air-fuel ratio within the combustion chambers 6 caused by supplying the purge gas (evaporated fuel) to the surge tank 34 of the intake passage 30 is detected by the linear $O_2$ sensor 55. The fuel injection controlling module 100*a* performs the feedback correction of the air-fuel ratio (i.e., fuel injection amount) based on the detected value (output value), and corrects the fuel injection amount according to the learned value of the concentration of the evaporated fuel, so as to compensate for a response lag of the feedback correction.

In this embodiment, the evaporated fuel concentration estimating module 100*i* estimates the concentration of the evaporated fuel within the purge gas when the purge is performed during the deceleration fuel cutoff, to be the learned value immediately before the deceleration fuel cutoff (the latest learned value stored in the memory 90). Also in this manner, a period of time for which the deceleration fuel cutoff is performed continuously is comparatively short and a possibility of the concentration of the evaporated fuel greatly changing during the time period is low; therefore, no problem will occur.

The evaporated fuel supply amount estimating module 100*f* estimates the supply amount of the evaporated fuel to the surge tank 34 when the purge is performed during the deceleration fuel cutoff.

Figure 3:
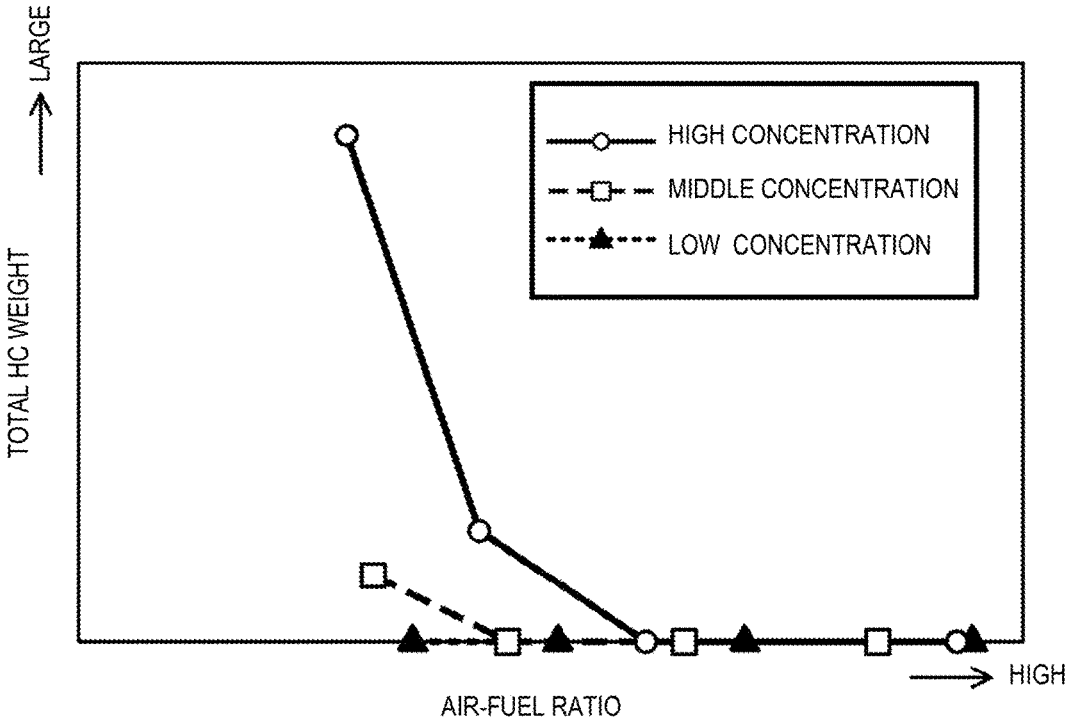
FIG. 3 is a chart illustrating relationships between an air-fuel ratio within combustion chambers and a total weight of hydrocarbons (HC) after passing through a downstream exhaust emission control catalyst, for cases where a concentration (learned value) of evaporated fuel indicates a high concentration, a medium concentration, and a low concentration, respectively.
Figure 4:
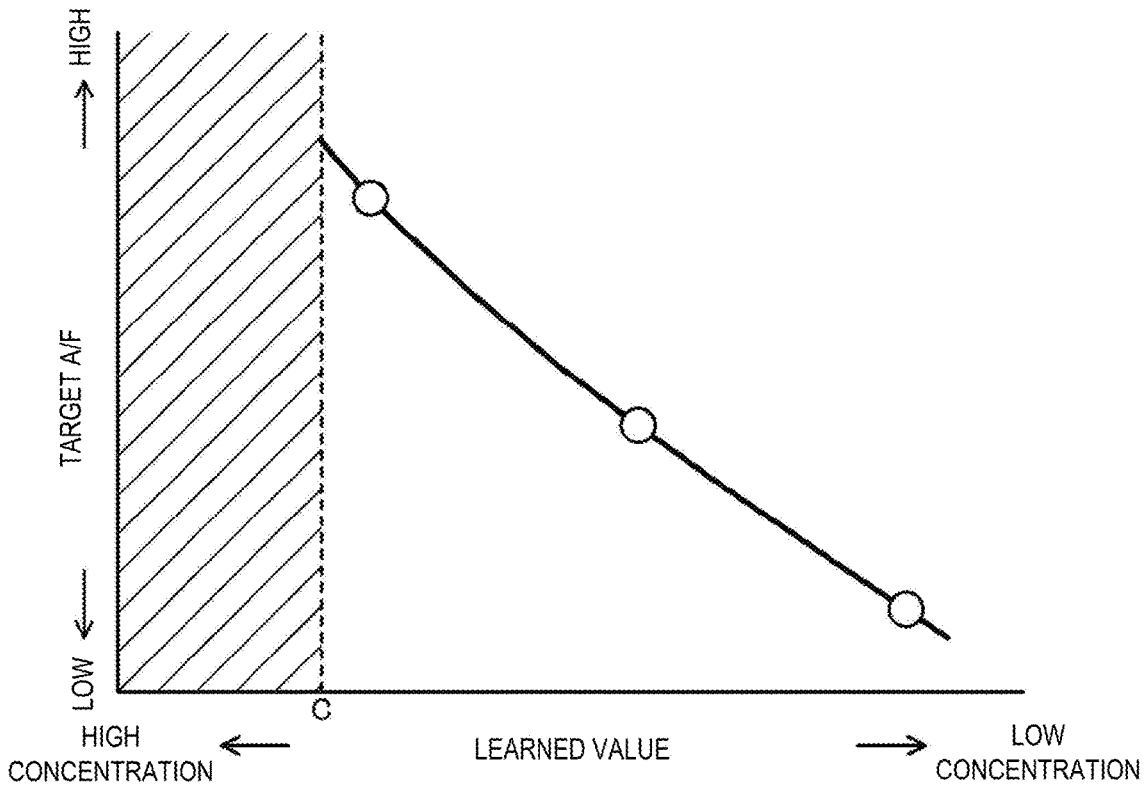
FIG. 4 is a chart illustrating a map indicating a relationship between the learned value of the concentration of the evaporated fuel and a target air-fuel ratio (A/F).

Specifically, a target air-fuel ratio (target A/F) when the purge is performed during the deceleration fuel cutoff is first calculated. FIG. 3 is a chart illustrating relationships between the air-fuel ratio within the combustion chambers 6 and a total weight of HC after passing through the downstream exhaust emission control catalyst 53, for cases where the concentration (learned value) of the evaporated fuel indicates a high concentration, a medium concentration, and a low concentration, respectively. From FIG. 3, it can be understood that at each concentration, the total weight of HC is reduced as the air-fuel ratio becomes higher, and when the air-fuel ratio exceeds a certain value, the total weight of HC becomes 0 (zero). Therefore, the target A/F may be set to be a value equal to or larger than a smallest value of air-fuel ratio at which the total weight of HC becomes 0 at each concentration (preferably be a value equal or close to the smallest air-fuel ratio, in view of increasing the supply amount of the purge gas to the surge tank 34 as much as possible when the purge is performed). The relationship between the learned value and the target A/F is stored in the memory 90 in advance in a form of a map as illustrated in FIG. 4, and by using the map, the target A/F is calculated based on the learned value obtained immediately before the deceleration fuel cutoff. Note that in the map, the target A/F is not set when the learned value indicates a concentration higher than a predetermined concentration C (the hatched section in FIG. 4), in other words, when the learned value indicates a concentration high enough that the evaporated fuel cannot suitably be purified by the exhaust emission control catalysts 52 and 53. In this case, the deceleration-fuel-cutoff purge valve controlling module 100*d* does not perform the purge (i.e., it fully closes the purge valve 75) during the deceleration fuel cutoff.

Further, a mass ratio ra of the evaporated fuel with respect to the entire purge gas is calculated based on the learned value. A total air mass qa sucked into the combustion chambers 6 and discharged to the exhaust passage 40 when the purge is performed during the deceleration fuel cutoff is calculated based on the output vale of the airflow sensor 32, the mass ratio ra, and the output value of the linear $O_2$ sensor 55.

When a mass of the evaporated fuel inside the combustion chambers 6 (same as the mass of the evaporated fuel within the purge gas) is "ggas,"

$$\text{target } A/F = qa/\text{ggas}.$$

Based on such a relationship, $$\text{ggas} = qa/(\text{target } A/F).$$

The mass ggas of the evaporated fuel inside the combustion chambers 6 is calculated by substituting the calculated values of the target A/F and the total air mass qa into this equation.

Further, when a mass of air within the purge gas is "gair,"

$$(1-ra):ra = \text{gair}:\text{ggas}.$$

Thus, $$\text{gair} = \text{ggas} \times (1-ra)/ra.$$

Based on this equation, the mass gair of the air within the purge gas is calculated.

When a total mass of the evaporated fuel and the air within the purge gas is "gprg,"

$$gprg=ggas+gair.$$

A purge gas volume qprg corresponding to the total mass gprg converted into volume is, with a density of the purge gas as cp, $$qprg=gprg\times cp.$$

Note that a value corresponding to the mass ratio ra of the evaporated fuel with respect to the entirety of the purge gas is stored in the memory 90 in advance as the density cp of the purge gas.

Note that the opening of the purge valve 75 can be determined based on the purge gas volume qprg and the pressure difference Pd. In this embodiment, as described later in detail, the opening is determined by also taking the temperature of one or more of the exhaust emission control catalysts (here, the upstream exhaust emission control catalyst 52) estimated by the catalyst temperature estimating module 100*g* as described later.

The evaporated fuel supply amount estimating module 100*f* estimates the supply amount of the evaporated fuel to the surge tank 34 when the purge is performed during the deceleration fuel cutoff, based on the opening of the purge valve 75 (determined based on the purge gas volume qprg, the pressure difference Pd, and the temperature of the upstream exhaust emission control catalyst 52) and the learned value.

The catalyst temperature estimating module 100*g* estimates the temperature of the upstream exhaust emission control catalyst 52 when the purge is performed during the deceleration fuel cutoff based on the supply amount of the evaporated fuel estimated by the evaporated fuel supply amount estimating module 100*f*.

Specifically, the catalyst temperature estimating module 100*g* estimates the temperature of the upstream exhaust emission control catalyst 52 when the purge is performed, based on the temperature of the exhaust gas immediately before the deceleration fuel cutoff is started, the supply amount of the evaporated fuel estimated by the evaporated fuel supply amount estimating module 100*f*, a heat generation amount Q1, and a heat release amount Q3. The heat generation amount Q1 is produced by combustion (oxidation), at the upstream exhaust emission control catalyst 52, of part of the unburned evaporated fuel which has reached the upstream exhaust emission control catalyst 52 when the purge is performed during the deceleration fuel cutoff (the entire evaporated fuel supplied to the surge tank 34 reaches the upstream exhaust emission control catalyst 52). The heat release amount Q3 is produced from the upstream exhaust emission control catalyst 52 to air passing through the upstream exhaust emission control catalyst 52 when the purge is performed, and the heat release amount Q3 is calculated based on the total air mass qa sucked into the combustion chambers 6.

Here, the exhaust gas temperature estimating module 100*j* continuously estimates the temperature of the exhaust gas based on the speed of the engine 1 obtained by the engine speed sensor 9 and a load of the engine 1 (obtained based on the speed of the engine 1 and the accelerator opening detected by the accelerator opening sensor 92), during the normal operation of the engine 1. The exhaust gas temperature estimating module 100*j* then stores (updates) the estimated value in the memory 90.

The temperature of the exhaust gas immediately before the deceleration fuel cutoff is started is the latest estimated value stored in the memory 90 at the start of the deceleration fuel cutoff. Note that as an alternative to the estimated value, the temperature of the exhaust gas may be detected by using a temperature sensor.

The catalyst temperature estimating module 100*g* estimates the temperature of the upstream exhaust emission control catalyst 52, by adding a temperature corresponding to the heat generation amount Q1 to the temperature of the exhaust gas (estimated value) and then subtracting therefrom a temperature corresponding to the heat release amount Q3.

Practically, the catalyst temperature estimating module 100*g* continuously estimates the temperature of the upstream exhaust emission control catalyst 52 and stores (updates) it in the memory 90 during the deceleration fuel cutoff. Specifically, immediately after the deceleration fuel cutoff is started, the catalyst temperature estimating module 100*g* adds a temperature corresponding to the heat generation amount Q1 produced in a period of time from the start of the deceleration fuel cutoff until the estimation is performed (the temperature is 0 (zero) when the purge is not performed) to the temperature of the exhaust gas (estimated value). The catalyst temperature estimating module 100*g* then subtracts therefrom a temperature corresponding to the heat release amount Q3 produced in the same time period, so as to estimate the temperature thcat of the upstream exhaust emission control catalyst 52 and store it in the memory 90. When performing the next estimation (latest estimation), the catalyst temperature estimating module 100*g* adds a temperature corresponding to the heat generation amount Q1 produced in a period of time between the immediately previous estimation and the latest estimation to the temperature thcat of the upstream exhaust emission control catalyst 52 stored in the memory 90 immediately before the latest estimation. The catalyst temperature estimating module 100*g* then subtracts therefrom a temperature corresponding to the heat release amount Q3 produced in the same time period, so as to estimate a latest value of the temperature thcat of the upstream exhaust emission control catalyst 52 and store (update) it in the memory 90.

The heat generation amount Q1 is calculated through multiplying a coefficient k (0 or higher but below 1) by a heat generation amount Q2 which is produced when the evaporated fuel which has reached the upstream exhaust emission control catalyst 52 is entirely combusted (oxidized). Here, for the sake of convenience, the heat generation amount Q2 is a heat generation amount produced when butane is combusted. The coefficient k is set larger as the temperature thcat of the upstream exhaust emission control catalyst 52 stored in the memory 90 becomes higher, which means a larger part of the evaporated fuel which has reached the upstream exhaust emission control catalyst 52 is combusted as the temperature thcat of the upstream exhaust emission control catalyst 52 becomes higher. Further, when the temperature thcat of the upstream exhaust emission control catalyst 52 is below a preset temperature (substantially the same as a predetermined temperature described later), the coefficient k becomes 0 and the heat generation amount Q1 also becomes 0. In other words, when the temperature thcat of the upstream exhaust emission control catalyst 52 is below the preset temperature, the unburned evaporated fuel is not combusted and the temperature of the upstream exhaust emission control catalyst 52 does not increase according to the heat generation amount Q1.

The deceleration-fuel-cutoff purge valve controlling module 100*d* controls the supply flow rate of the purge gas to the surge tank 34 (the opening of the purge valve 75) when the purge is performed during the deceleration fuel cutoff, based on the purge gas volume qprg, the pressure difference Pd, and additionally the temperature thcat of the upstream exhaust emission control catalyst 52 estimated by the catalyst temperature estimating module 100*g*. Note that since the purge gas volume qprg is obtained based on the estimated value of the concentration of the evaporated fuel within the purge gas by the evaporated fuel concentration estimating module 100*i*, the deceleration-fuel-cutoff purge valve controlling module 100*d* controls the supply flow rate of the purge gas to the surge tank 34 when the purge is performed during the deceleration fuel cutoff, based on the concentration of the evaporated fuel within the purge gas estimated by the evaporated fuel concentration estimating module 100*i*, and the temperature thcat of the upstream exhaust emission control catalyst 52.

Specifically, as the temperature thcat of the upstream exhaust emission control catalyst 52 estimated by the catalyst temperature estimating module 100*g* is lower, the deceleration-fuel-cutoff purge valve controlling module 100*d* reduces the supply flow rate of the purge gas to the surge tank 34 when the purge is performed during the deceleration fuel cutoff. Moreover, when the temperature thcat of the upstream exhaust emission control catalyst 52 estimated by the catalyst temperature estimating module 100*g* is lower than a predetermined temperature, the deceleration-fuel-cutoff purge valve controlling module 100*d* stops the purge (adjusts the opening of the purge valve 75 to 0). The predetermined temperature is set so that the purifying performance of the exhaust emission control catalyst significantly degrades when falling below the predetermined temperature, for example, it is equal or close to an activation temperature of the upstream exhaust emission control catalyst 52.

The catalyst temperature increasing amount estimating module 100*h* continuously estimates an increasing amount of the temperature of the upstream exhaust emission control catalyst 52 when the unburned evaporated fuel accumulated in the upstream exhaust emission control catalyst 52 due to the purge during the deceleration fuel cutoff is assumed to have entirely combusted at once.

Specifically, a total heat generation amount Qt when the unburned evaporated fuel accumulated in the upstream exhaust emission control catalyst 52 is assumed to have entirely combusted at once can be obtained based on $$Qt=\Sigma(Q2-Q1).$$

In other words, the heat generation amount Q1 within the heat generation amount Q2 is for the evaporated fuel which is already combusted, and the value of Q2-Q1 is a heat generation amount by the unburned evaporated fuel accumulated in the upstream exhaust emission control catalyst 52 without being combusted, and a summation of Q2-Q1 is the total heat generation amount Qt by the unburned evaporated fuel accumulated in the upstream exhaust emission control catalyst 52 from the start of the purge to a current timing. The catalyst temperature increasing amount estimating module 100*h* estimates the increasing amount of the temperature of the upstream exhaust emission control catalyst 52 based on the total heat generation amount Qt.

While the purge is performed, when the increasing amount of the temperature of the upstream exhaust emission control catalyst 52 estimated by the catalyst temperature increasing amount estimating module 100*h* exceeds a preset value, the deceleration-fuel-cutoff purge valve controlling module 100*d* stops the purge (adjusts the opening of the purge valve 75 to zero). The preset value is set so that deterioration of the upstream exhaust emission control catalyst 52 due to a sharp temperature increase can be suppressed.

When the deceleration fuel cutoff is ended and shifted to the normal operation of the engine 1, the unburned evaporated fuel accumulated in the upstream exhaust emission control catalyst 52 by the purge during the deceleration fuel cutoff is entirely combusted at once due to the exhaust gas at high temperature which is produced by combustion of the fuel injected by the injectors 18. Thus, the temperature of the upstream exhaust emission control catalyst 52 sharply increases. Here, if the temperature increases excessively, the deterioration of the upstream exhaust emission control catalyst 52 will be stimulated. In order to suppress such deterioration, the purge is stopped once the increasing amount of the temperature of the upstream exhaust emission control catalyst 52 estimated by the catalyst temperature increasing amount estimating module 100*h* exceeds the preset value.

Figure 5:
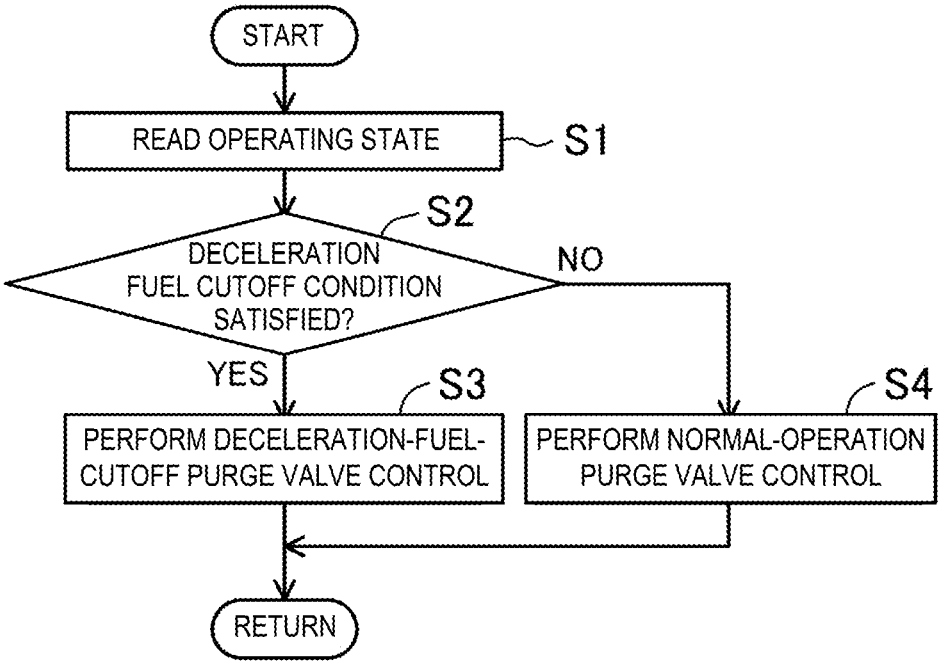
FIG. 5 is a flowchart illustrating a processing operation regarding a purge performed by the control system.

Next, the processing operation regarding the purge performed by the control system 100 is described with reference to the flowchart in FIG. 5.

First at S1, the operating state of the engine 1 is read, and then at S2, whether the deceleration fuel cutoff condition is satisfied or not satisfied is determined.

If the determination result of S2 is positive, the operation proceeds to S3 where the deceleration-fuel-cutoff purge valve control (the control of the purge valve 75 by the deceleration-fuel-cutoff purge valve controlling module 100*d*) is performed, then returns to the start of the operation.

On the other hand, if the determination result of S2 is negative, the operation proceeds to S4 where the normal-operation purge valve control (the control of the purge valve 75 by the normal-operation purge valve controlling module 100*c*) is performed, then returns to the start of the operation.

Figure 6:
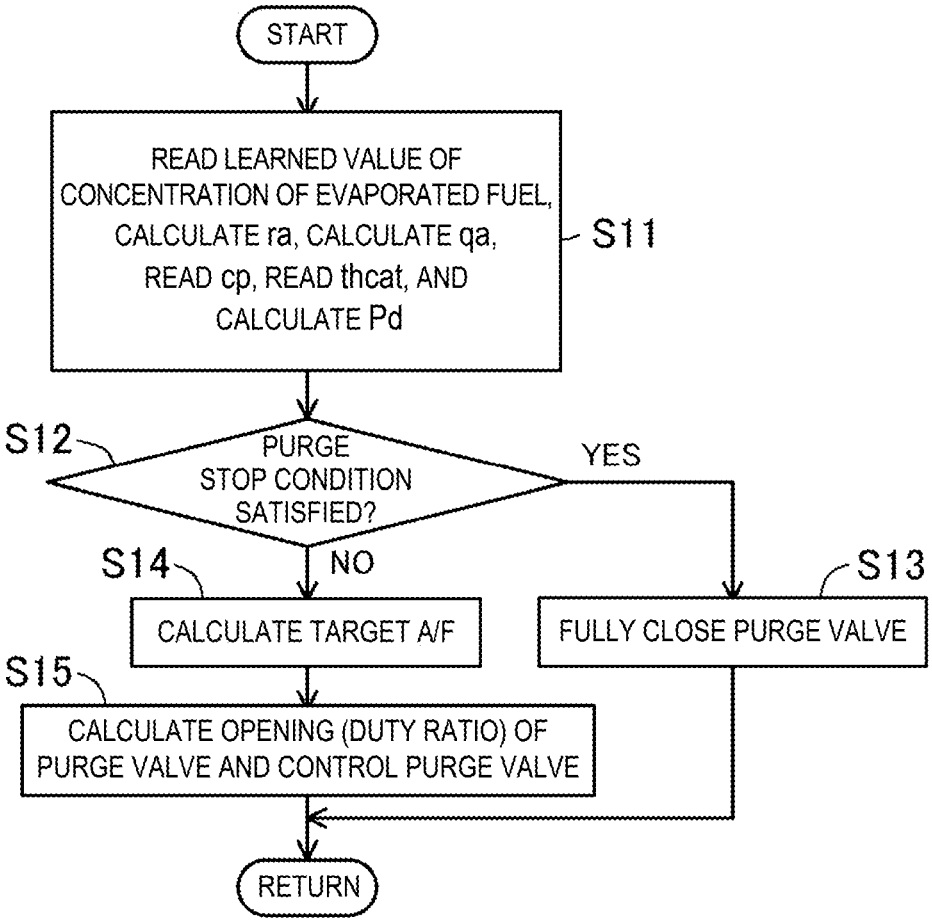
FIG. 6 is a flowchart illustrating a processing operation of a deceleration-fuel-cutoff purge valve control.

The processing operation of the deceleration-fuel-cutoff purge valve control at S3 is described in greater detail with reference to the flowchart in FIG. 6.

First at S11, the learned value of the concentration of the evaporated fuel is read from the memory 90, the mass ratio ra of the evaporated fuel with respect to the entire purge gas is calculated based on the learned value, and the total air mass qa sucked into the combustion chambers 6 is calculated based on the output value of the airflow sensor 32, the mass ratio ra, and the output value of the linear $O_2$ sensor 55. Further, the density cp corresponding to the mass ratio ra and the estimated value thcat of the temperature of the upstream exhaust emission control catalyst 52 are read from the memory 90, and the pressure difference Pd between the pressure detected by the pressure sensor 35 and the pressure detected by the atmospheric pressure sensor 91 is calculated.

Next at S12, whether a purge stop condition is satisfied or not satisfied is determined. The purge stop condition includes a condition in which the temperature thcat of the upstream exhaust emission control catalyst 52 estimated by the catalyst temperature estimating module 100*g* falls below the predetermined temperature when the purge is performed, and a condition in which the increasing amount of the temperature of the upstream exhaust emission control catalyst 52 estimated by the catalyst temperature increasing amount estimating module 100*h* exceeds the preset value when the purge is performed.

If the determination result of S12 is positive, the operation proceeds to S13 where the purge valve 75 is fully closed, then returns to the start of the operation.

On the other hand, if the determination result of S12 is negative, the operation proceeds to S14 where the target A/F is calculated based on the learned value by using the map in FIG. 4. Here, if the learned value indicates a concentration above the predetermined concentration C (the hatched section in FIG. 4), the purge is not performed (the purge valve 75 is fully closed).

Next at S15, the purge gas volume qprg is calculated based on the target A/F, the mass ratio ra, the total air mass qa, and the density cp, the opening of the purge valve 75 (the duty ratio described above) is calculated based on the purge gas volume qprg, the pressure difference Pd, and the estimated temperature value thcat of the upstream exhaust emission control catalyst 52, and the purge valve 75 is controlled to have the calculated opening. Then, the operation returns to the start of the operation.

Figure 7:
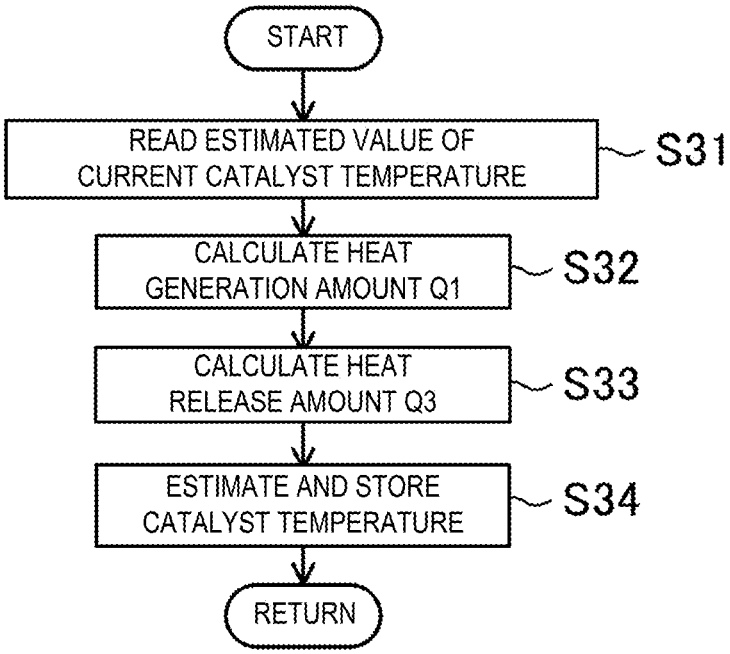
FIG. 7 is a flowchart illustrating a processing operation of estimating a temperature of an upstream exhaust emission control catalyst by a catalyst temperature estimating module when the purge is performed during a deceleration fuel cutoff.

Next, the processing operation performed by the catalyst temperature estimating module 100*g* to estimate the temperature of the upstream exhaust emission control catalyst 52 when the purge is performed during the deceleration fuel cutoff is described with reference to the flowchart in FIG. 7.

First, at S31, the estimated value thcat of the current temperature of the upstream exhaust emission control catalyst 52 is read from the memory 90 (however, when reading immediately after the deceleration fuel cutoff is started, the temperature of the exhaust gas is read instead).

Next, at S32, the heat generation amount Q1 produced in the time period between the immediately previous estimation and the latest estimation is calculated. Specifically, the heat generation amount Q2 produced when the evaporated fuel which has reached the upstream exhaust emission control catalyst 52 is entirely combusted (oxidized) during the same time period is calculated, the coefficient k corresponding to the estimated value thcat is read from the memory 90, and the heat generation amount Q1 is then calculated through multiplying the coefficient k by the heat generation amount Q2.

Then, at S33, the heat release amount Q3 produced in the same time period between the immediately previous estimation and the latest estimation is calculated. Subsequently at S34, the temperature corresponding to the heat generation amount Q1 is added to the estimated value thcat and the temperature corresponding to the heat release amount Q3 is subtracted therefrom, so as to estimate a latest temperature thcat of the upstream exhaust emission control catalyst 52 and store it in the memory 90 for an update.

Figure 8:
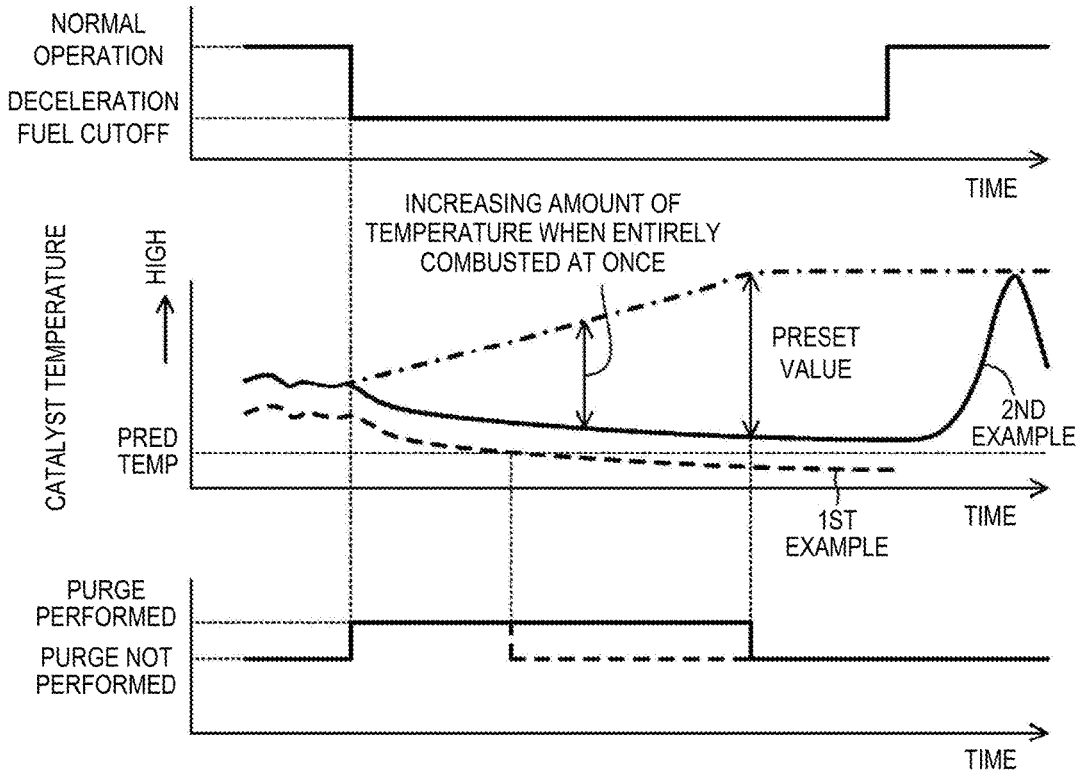
FIG. 8 shows time charts illustrating examples of a change of the temperature of the upstream exhaust emission control catalyst when the purge is performed during the deceleration fuel cutoff.

FIG. 8 shows time charts illustrating examples (a first example indicated by the dashed line and a second example indicated by the solid line) of the change of the temperature of the upstream exhaust emission control catalyst 52 when the purge is performed during the deceleration fuel cutoff.

The first example is an example wherein the temperature of the upstream exhaust emission control catalyst 52 falls below the predetermined temperature when the purge is performed. In the first example, the purge is stopped when the temperature of the upstream exhaust emission control catalyst 52 falls below the predetermined temperature.

The second example is an example wherein although the temperature of the upstream exhaust emission control catalyst 52 does not fall below the predetermined temperature, the increasing amount of the temperature of the upstream exhaust emission control catalyst 52 when the unburned evaporated fuel accumulated in the upstream exhaust emission control catalyst 52 by the purge is assumed to have entirely combusted at once exceeds the preset value. The line indicated by the one-dotted chain line is the temperature of the upstream exhaust emission control catalyst 52 after the temperature increase.

In the second example, the purge is stopped when the increasing amount exceeds the preset value. After stopping, since the unburned evaporated fuel is not accumulated in the upstream exhaust emission control catalyst 52, the increasing amount becomes the preset value. When the deceleration fuel cutoff is ended and shifted to the normal operation of the engine 1, the unburned evaporated fuel is entirely combusted at once and the temperature of the upstream exhaust emission control catalyst 52 sharply increases. However, the increasing amount of the temperature here becomes the preset value, and therefore, the deterioration of the upstream exhaust emission control catalyst 52 due to the sharp temperature increase can be suppressed.

As described above, in this embodiment, the deceleration-fuel-cutoff purge valve controlling module 100*d* controls the supply flow rate of the purge gas to the surge tank 34 (the opening of the purge valve 75) when the purge is performed during the deceleration fuel cutoff of the engine 1, based on the purge gas volume qprg (i.e., the estimated value of the concentration of the evaporated fuel within the purge gas), the pressure difference Pd, and the temperature thcat of the upstream exhaust emission control catalyst 52 estimated by the catalyst temperature estimating module 100*g*. Thus, the supply flow rate of the purge gas to the surge tank 34 when the purge is performed can be adjusted according to the purifying performance of the upstream exhaust emission control catalyst 52 which is influenced by its temperature, and the supply amount of the purge gas to the surge tank 34 can be secured as much as possible while suppressing degradation of emission performance.

In this embodiment, the supply flow rate of the purge gas to the surge tank 34 when the purge is performed during the deceleration fuel cutoff is reduced as the temperature thcat of the upstream exhaust emission control catalyst 52 becomes lower. Further, when the temperature thcat of the upstream exhaust emission control catalyst 52 falls below the predetermined temperature while the purge is performed, the purge is stopped. Therefore, the degradation of the emission performance can securely be suppressed.

The present invention is not limited to the above embodiment, and may be substituted without deviating from the scope of the claims.

For example, in the above-described embodiment, the engine 1 has a turbocharger; however, the turbocharger may be omitted.

The above-described embodiment is merely an illustration, and therefore, the present invention must not be interpreted in a limited way. The scope of the present invention is defined by the claims, and all of modifications and changes falling under the equivalent range of the claims are within the scope of the present invention.

The present invention is useful for control systems of engines in which purge gas containing evaporated fuel desorbed from a canister is supplied to an intake passage, and particularly useful when the engine has a turbocharger.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

LIST OF REFERENCE CHARACTERS

1 Engine
30 Intake Passage

50 Turbocharger
50*a* Compressor
50*b* Turbine
52 Upstream Exhaust Emission Control Catalyst
53 Downstream Exhaust Emission Control Catalyst
70 Canister
73 Purge Tube (Purge Line) (Purging Unit)
75 Purge Valve (Purging Unit)
100*d* Deceleration-fuel-cutoff Purge Valve Controlling Module (Purge Valve Controlling Module) (Purging Unit)
100*e* Deceleration-fuel-cutoff Controlling Module (Deceleration Fuel Cutoff Module)
100*f* Evaporated Fuel Supply Amount Estimating Module
100*g* Catalyst Temperature Estimating Module
100*h* Catalyst Temperature Increasing Amount Estimating Module
100*i* Evaporated Fuel Concentration Estimating Module
100*j* Exhaust Gas Temperature Estimating Module

What is claimed is:

1. A control system of an engine in which a purge gas containing evaporated fuel desorbed from a canister is supplied to an intake passage of the engine, the control system comprising:

an exhaust emission control catalyst provided in an exhaust passage of the engine;

a purging unit including a purge line and a purge valve for performing a purge to supply the purge gas to the intake passage of the engine during a deceleration fuel cutoff; and a processor configured to execute:

a deceleration fuel cutoff module for performing the deceleration fuel cutoff to stop a fuel supply from an injector to the engine when a predetermined deceleration fuel cutoff condition is satisfied in a decelerating state of the engine;

an evaporated fuel supply amount estimating module for estimating a supply amount of the evaporated fuel to the intake passage when the purge is performed; and a catalyst temperature estimating module for estimating a temperature of the exhaust emission control catalyst when the purge is performed, based on the estimated supply amount of the evaporated fuel; and a catalyst temperature increasing amount estimating module for continuously estimating an increasing amount of the temperature of the exhaust emission control catalyst when unburned evaporated fuel accumulated in the exhaust emission control catalyst by the purge is assumed to have entirely combusted at once, wherein the purging unit controls a supply flow rate of the purge gas to the intake passage when the purge is performed, based on the estimated temperature of the exhaust emission control catalyst, and wherein while the purge is performed, the purging unit stops the purge once the estimated increasing amount of the temperature of the exhaust emission control catalyst exceeds a preset value.

2. The control system of claim 1, wherein the purging unit stops the purge when the estimated temperature of the exhaust emission control catalyst falls below a predetermined temperature while the purge is performed.

3. The control system of claim 1, wherein the processor is further configured to execute an evaporated fuel concentration estimating module for estimating a concentration of the evaporated fuel within the purge gas when the purge is performed, wherein the purging unit further controls the supply flow rate of the purge gas to the intake passage when the purge is performed, based on the estimated concentration of the evaporated fuel.

4. The control system of claim 3, wherein the purging unit does not perform the purge during the deceleration fuel cutoff when the estimated concentration of the evaporated fuel is above a predetermined concentration.

5. The control system of claim 1, wherein the processor is further configured to execute an exhaust gas temperature detecting/estimating module for detecting or estimating a temperature of exhaust gas of the engine when the engine is operated by supplying fuel from the injector to the engine and combusting the fuel, wherein the catalyst temperature estimating module estimates the temperature of the exhaust emission control catalyst when the purge is performed, based on the temperature of the exhaust gas detected or estimated immediately before the deceleration fuel cutoff is started, the estimated supply amount of the evaporated fuel, a heat generation amount, and a heat release amount, the heat generation amount produced by combustion, at the exhaust emission control catalyst, of part of the evaporated fuel which has reached the exhaust emission control catalyst when the purge is performed, the heat release amount produced from the exhaust emission control catalyst to air passing through the exhaust emission control catalyst when the purge is performed.

6. The control system of claim 1, further comprising a turbocharger having a compressor disposed in the intake passage of the engine, wherein the purge line communicates the canister with a part of the intake passage downstream of the compressor, the purge valve is provided in the purge line, and the purging unit further includes a purge valve controlling module for controlling the supply flow rate of the purge gas to the intake passage by controlling an operation of the purge valve when the purge is performed.

7. The control system of claim 1, wherein the purging unit reduces the supply flow rate of the purge gas to the intake passage when the purge is performed, as the estimated temperature of the exhaust emission control catalyst becomes lower.

8. The control system of claim 7, wherein the purging unit stops the purge when the estimated temperature of the exhaust emission control catalyst falls below a predetermined temperature while the purge is performed.

9. The control system of claim 8, wherein the processor is further configured to execute an evaporated fuel concentration estimating module for estimating a concentration of the evaporated fuel within the purge gas when the purge is performed, wherein the purging unit further controls the supply flow rate of the purge gas to the intake passage when the purge is performed, based on the estimated concentration of the evaporated fuel.

10. The control system of claim 8, wherein the processor is further configured to execute an exhaust gas temperature detecting/estimating module for detecting or estimating a temperature of exhaust gas of the engine when the engine is operated by supplying fuel from the injector to the engine and combusting the fuel, wherein the catalyst temperature estimating module estimates the temperature of the exhaust emission control catalyst when the purge is performed, based on the temperature of the exhaust gas detected or estimated immediately before the deceleration fuel cutoff is started, the estimated supply amount of the evaporated fuel, a heat generation amount, and a heat release amount, the heat generation amount produced by combustion, at the exhaust emission control catalyst, of part of the evaporated fuel which has reached the exhaust emission control catalyst when the purge is performed, the heat release amount produced from the exhaust emission control catalyst to air passing through the exhaust emission control catalyst when the purge is performed.

11. The control system of claim 7, wherein the processor is further configured to execute an evaporated fuel concentration estimating module for estimating a concentration of the evaporated fuel within the purge gas when the purge is performed, wherein the purging unit further controls the supply flow rate of the purge gas to the intake passage when the purge is performed, based on the estimated concentration of the evaporated fuel.

12. The control system of claim 7, wherein the processor is further configured to execute an exhaust gas temperature detecting/estimating module for detecting or estimating a temperature of exhaust gas of the engine when the engine is operated by supplying fuel from the injector to the engine and combusting the fuel, wherein the catalyst temperature estimating module estimates the temperature of the exhaust emission control catalyst when the purge is performed, based on the temperature of the exhaust gas detected or estimated immediately before the deceleration fuel cutoff is started, the estimated supply amount of the evaporated fuel, a heat generation amount, and a heat release amount, the heat generation amount produced by combustion, at the exhaust emission control catalyst, of part of the evaporated fuel which has reached the exhaust emission control catalyst when the purge is performed, the heat release amount produced from the exhaust emission control catalyst to air passing through the exhaust emission control catalyst when the purge is performed.

13. The control system of claim 1, wherein the purging unit does not perform the purge during the deceleration fuel cutoff when the estimated concentration of the evaporated fuel is above a predetermined concentration.

14. The control system of claim 13, wherein the processor is further configured to execute an exhaust gas temperature detecting/estimating module for detecting or estimating a temperature of exhaust gas of the engine when the engine is operated by supplying fuel from the injector to the engine and combusting the fuel, wherein the catalyst temperature estimating module estimates the temperature of the exhaust emission control catalyst when the purge is performed, based on the temperature of the exhaust gas detected or estimated immediately before the deceleration fuel cutoff is started, the estimated supply amount of the evaporated fuel, a heat generation amount, and a heat release amount, the heat generation amount produced by combustion, at the exhaust emission control catalyst, of part of the evaporated fuel which has reached the exhaust emission control catalyst when the purge is performed, the heat release amount produced from the exhaust emission control catalyst to air passing through the exhaust emission control catalyst when the purge is performed.

15. The control system of claim 14, further comprising a turbocharger having a compressor disposed in the intake passage of the engine, wherein the purge line communicates the canister with a part of the intake passage downstream of the compressor, the purge valve is provided in the purge line, and the purging unit further includes a purge valve controlling module for controlling the supply flow rate of the purge gas to the intake passage by controlling an operation of the purge valve when the purge is performed.

16. A control system of an engine in which a purge gas containing evaporated fuel desorbed from a canister is supplied to an intake passage of the engine, the control system comprising:

an exhaust emission control catalyst provided in an exhaust passage of the engine;

a purging unit including a purge line and a purge valve for performing a purge to supply the purge gas to the intake passage of the engine during a deceleration fuel cutoff; and a processor configured to execute:

a deceleration fuel cutoff module for performing the deceleration fuel cutoff to stop a fuel supply from an injector to the engine when a predetermined deceleration fuel cutoff condition is satisfied in a decelerating state of the engine;

an evaporated fuel supply amount estimating module for estimating a supply amount of the evaporated fuel to the intake passage when the purge is performed; and a catalyst temperature estimating module for estimating a temperature of the exhaust emission control catalyst when the purge is performed, based on the estimated supply amount of the evaporated fuel, wherein the purging unit controls a supply flow rate of the purge gas to the intake passage when the purge is performed, based on the estimated temperature of the exhaust emission control catalyst, and wherein the catalyst temperature estimating module estimates the temperature of the exhaust emission control catalyst when the purge is performed, based on the temperature of the exhaust gas detected or estimated immediately before the deceleration fuel cutoff is started, the estimated supply amount of the evaporated fuel, a heat generation produced by combustion, at the exhaust emission control catalyst, of part of the evaporated fuel which has reached the exhaust emission control catalyst when the purge is performed, and a heat release amount produced from the exhaust emission control catalyst to air passing through the exhaust emission control catalyst when the purge is performed.

* * * * *